US009212529B2

(12) United States Patent
Hallundbæk et al.

(10) Patent No.: US 9,212,529 B2
(45) Date of Patent: Dec. 15, 2015

(54) DOWNHOLE TOOL HEAD FOR RELEASING PRECIPITATED SOLIDS

(75) Inventors: Jørgen Hallundbæk, Græsted (DK); Sven Karsten Jensen, Stenløse (DK)

(73) Assignee: WELLTEC A/S, Allerod (DK)

( * ) Notice: Subject to any disclaimer, the term of this patent is extended or adjusted under 35 U.S.C. 154(b) by 889 days.

(21) Appl. No.: 13/391,047

(22) PCT Filed: Aug. 20, 2010

(86) PCT No.: PCT/EP2010/062195

§ 371 (c)(1), (2), (4) Date: Feb. 17, 2012

(87) PCT Pub. No.: WO2011/020917

PCT Pub. Date: Feb. 24, 2011

(65) Prior Publication Data

US 2012/0145377 A1 Jun. 14, 2012

(30) Foreign Application Priority Data

Aug. 21, 2009 (EP) ..... 09168401

(51) Int. Cl.

| | |
|---|---|
| ***E21B 27/00*** | (2006.01) |
| ***B08B 9/043*** | (2006.01) |
| ***B08B 9/051*** | (2006.01) |
| ***E21B 37/02*** | (2006.01) |

(52) U.S. Cl.

CPC ..... *E21B 27/00* (2013.01); *B08B 9/0436* (2013.01); *B08B 9/051* (2013.01); *E21B 37/02* (2013.01)

(58) Field of Classification Search

CPC ..... E21B 37/00; E21B 37/02; E21B 27/00; B08B 9/051; B08B 9/0436

See application file for complete search history.

(56) References Cited

U.S. PATENT DOCUMENTS

| | | | | |
|---|---|---|---|---|
| 2,830,663 | A | 4/1958 | Kirby | |
| 2,890,756 | A | 6/1959 | Middleton | |
| 4,084,636 | A | 4/1978 | Burge | |
| 2006/0243303 | A1* | 11/2006 | Harr | 134/6 |
| 2007/0131426 | A1* | 6/2007 | Telfer | 166/301 |

FOREIGN PATENT DOCUMENTS

| | | | |
|---|---|---|---|
| CN | 2108715 | U | 7/1992 |

OTHER PUBLICATIONS

International Preliminary Report on Patentability and Written Opinion for corresponding PCT/EP2010/062195, issued Feb. 21, 2012 (6 pages).

International Search Report for PCT/EP2010/062195 mailed Dec. 8, 2010.

Written Opinion of the International Searching Authority mailed Aug. 20, 2010.

* cited by examiner

*Primary Examiner* — Giovanna C Wright
*Assistant Examiner* — Kristyn Hall
(74) *Attorney, Agent, or Firm* — Nixon & Vanderhye P.C.

(57) ABSTRACT

The present invention relates to a downhole tool head (1) for mounting onto a downhole tool (10) for drilling in a formation downhole or for releasing precipitated solids (2), such as ice, scales or the like, in a cavity fluid in a pipeline, a casing (3), a well or any other cavity downhole. The downhole tool head comprises a hollow cylindrical body (4) with a circumferential wall (5) extending from a base part of the body, the circumferential wall having a circumferential rim (6) in its end opposite the base part. The circumferential rim (6) comprises a plurality of edges (8) for cutting, grinding, drilling and/or milling, and the base part has a plurality of through-going holes (9) for letting cavity fluid comprising precipitated solids pass the holes.

19 Claims, 7 Drawing Sheets

D-D

DOWNHOLE TOOL HEAD FOR RELEASING PRECIPITATED SOLIDS

This application is the U.S. national phase of International Application No.

PCT/EP 2010/062195 filed 20 Aug. 2010 which designated the U.S. and claims priority to EP09168401.9 filed 21Aug. 2009, the entire contents of each of which are hereby incorporated by reference.

TECHNICAL FIELD

The present invention relates to a downhole tool head for mounting onto a downhole tool for releasing of precipitated solids, such as ice, scales or the like in a cavity fluid in a pipeline, a casing, a well or any other cavity.

BACKGROUND

Pipelines are used to transport oil, gas and the like, e.g. from oil rigs to the shore. Such oil fluid contains constituents of water, and since the pipelines lie on the sea-bed covered by water, the ambient temperature may result in a cooling of the oil fluid to such an extent that the water constituents precipitate as ice on the inside wall of the pipeline. The precipitated ice may, at least partly, block the flow in the pipelines, thus decreasing the velocity of the oil fluid.

Furthermore, casings downhole may, at least partly, be blocked by scales due to the fact that the water constituents in the oil may comprise alkaline earth cations and anions, and water-insoluble scales are formed when cations and anions are present in a certain concentration.

When the precipitated solids, such as ice and scales, are loosened, some solids are of a size making them unable to pass the known releasing tools, causing the tool to get stuck.

Furthermore, when drilling downhole, formation pieces are released from the formation, and such pieces may also be of such size that the pieces are not able to pass the tool.

DESCRIPTION OF THE INVENTION

An aspect of the present invention is, at least partly, to overcome the above-mentioned disadvantages by providing an improved a downhole tool which is able to crush, crack, and/or grind solids such as ice, scales or formation pieces to prevent them from hindering the operation of the tool.

This aspect and the advantages becoming evident from the description below are obtained by a downhole tool head for mounting onto a downhole tool for drilling in a formation downhole or for releasing precipitated solids, such as ice, scales or the like, in a cavity fluid in a pipeline, a casing, a well or any other cavity downhole, comprising:

a hollow cylindrical body with a circumferential wall extending from a base part of the body, the circumferential wall having a circumferential rim in its end opposite the base part, wherein the circumferential rim comprises a plurality of edges for cutting, grinding, drilling and/or milling, and wherein the base part has a plurality of through-going holes for letting cavity fluid comprising precipitated solids pass the holes.

In one embodiment, the holes may have a cutting edge for cutting into precipitated solids released from the cavity and for dividing the precipitated solids into several pieces, In another embodiment, both the pieces and the solids may be larger than the holes.

The above-mentioned base part of the downhole tool head may have a base part area, and the holes in the base part may constitute more than 20% of the base part area, preferably more than 30% of the base part area, more preferably more than 40% of the base part area, and even more preferably more than 50% of the base part area.

Moreover, at least one of the holes may extend from the base part and up along the circumferential wall.

Each hole in the base part may have a width which constitutes more than 1% of the base part area, preferably more than 3% of the base part area, more preferably more than 5% of the base part area, and even more preferably more than 8% of the base part area.

Moreover, the cutting edge (12) of the hole has a radius of curvature between 0.0 mm and 1.0 mm, preferably between 0.0 mm and 0.5 mm, and more preferably between 0.0 mm and 0.2 mm The circumferential wall may have a plurality of holes.

In addition, the circumferential wall may have a circumferential wall area, and the holes in the circumferential wall may constitute more than 20% of the circumferential wall area, preferably more than 30% of the circumferential wall area, more preferably more than 40% of the circumferential wall area, and even more preferably more than 50% of the circumferential wall area.

Moreover, each hole in the circumferential wall may have a width which constitutes more than 1% of the circumferential wall area, preferably more than 3% of the circumferential wall area, more preferably more than 5% of the circumferential wall area, and even more preferably more than 8% of the circumferential wall area.

Also, the circumferential rim may have at least three edges distributed along the rim, preferably at least four edges, more preferably at least six edges, and even more preferably at least eight edges.

The edges may constitute more than 5% of the circumferential rim, preferably more than 10% of the circumferential rim, and more preferably 25% of the circumferential rim.

Moreover, a cross-section of at least one of the holes may be round, square or star-shaped.

In one embodiment, an element may be arranged between the downhole tool and the downhole tool head, the element comprising channels extending from an element face facing the base part of the downhole tool head and ending at a side of the element to let cavity fluid out through the side.

At least one opening of the channel may overlap a hole in the base part while the downhole tool head rotates around a longitudinal axis of the tool.

In addition, the element face of the element may be arranged at a distance from the base part of less than the width of a hole in the base part of the downhole tool head.

The invention also relates to a use of the downhole tool head with a tool for releasing precipitated solids, such as ice, scales or the like, in a cavity fluid in a pipeline, a casing, a well or any other cavity.

Moreover, the invention relates to a downhole tool for drilling in a formation or the like downhole, comprising:

the above-mentioned downhole tool head, and a driving unit for rotating the downhole tool head, wherein the downhole tool head may be provided on a shaft in connection with the driving unit.

Finally, the invention relates to a downhole system for performing operations downhole, comprising:

the above-mentioned downhole tool, and a driving tool, such as a downhole tractor, for moving the downhole tool in the well.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1A:
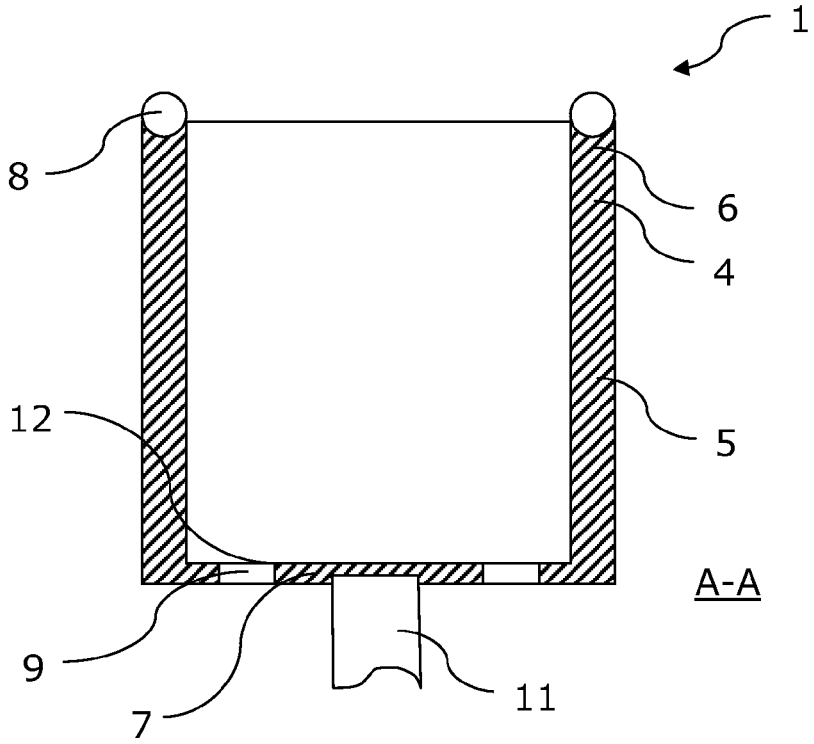
FIG. 1A shows a cross-sectional view of a downhole tool head according to the invention.
Figure 1B:
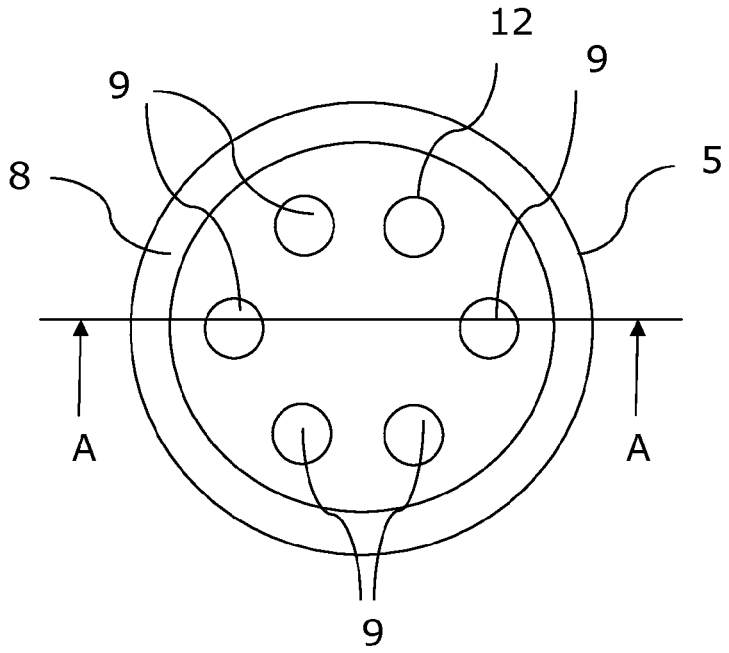
FIG. 1B shows the downhole tool head of FIG. 1A seen from above.

In FIGS. 1A and 1B, a downhole tool head 1 according to the invention is shown. The downhole tool head 1 has a cylindrical body 4 which is hollow in that it is constituted by a circumferential wall 5 and base part 7. In FIG. 1A, the base part is the same as the bottom part of the downhole tool head. The downhole tool head 1 is used for drilling in a formation downhole or for releasing precipitated solids 2, such as ice, scales or the like, in a cavity fluid in a pipeline, a casing 3, a well or any other cavity downhole.

The circumferential wall 5 has a circumferential rim 6 which comprises a plurality of edges 8 for cutting, grinding, drilling and/or milling. These edges may e.g. constitute part of teeth, bits, grindstone or inserts, such as tungsten carbide inserts (TCI).

A pipeline is used to transport fluid, such as oil, a mix of oil with water, gas, etc., from an oil rig to the refineries on shore. In many drilling operations, the oil fluid is mixed with filtrate or other additives in order to improve the drilling process. Furthermore, the fluid may contain other elements, such as cuttings, swarfs, sand, pipe dope, remains from a previous explosion, rust from the casing in the well, or detachments torn off from the well, the casing or the formation. In the following, the invention will be explained with reference to a casing 3 or another downhole cavity in a formation with oil fluid even though the fluid may also be a gas, etc.

Thus, the downhole tool head 1 is surrounded by oil fluid transporting the released solids or formation pieces.

When drilling in the formation downhole, formation pieces are torn off the formation, and since the downhole tool head 1 is hollow, the formation pieces are collected in the hollow cylindrical body 4 and are forced to pass the holes 9 in the base part 7, being the bottom of the body. When the formation pieces hit the cutting edges 12 of the hole, the formation pieces are somewhat crushed in that parts of the pieces are cut off. In this way, the formation pieces are reduced in size so that they are able to easily pass in the space between the inside wall of the formation and the outside wall of the downhole tool.

When the downhole tool head 1 is used for releasing solids 2 precipitated on the inside wall of a pipeline or a casing 3, the released solids are likewise forced to enter the holes 9 in the bottom part 7 of the cylindrical body 4 due to the shape of the downhole tool head 1. Thus, the oil fluid forces the solids towards the holes 9, and when the solids hit the cutting edges 12 of the hole, parts of the solids are likewise cut off.

In this way, the downhole tool head 1 is able to reduce the size of both the released precipitated solids 2 and the formation pieces to a certain size so that the reduced solids or pieces are able to pass the tool, ensuring that the downhole tool does not get stuck during an operation.

The cutting edges 12 of the holes in the downhole tool head have a radius of curvature between 0.0 mm and 1.0 mm, preferably between 0.0 mm and 0.5 mm, and more preferably between 0.0 mm and 0.2 mm.

As shown in FIG. 1A, the base part 7 has six through-going holes 9, all of which have a round cross-section (cf. FIG. 1B). Each hole 9 in the base part 7 has a width which constitutes more than 1% of the base part area 14, in this embodiment around 3% of the base part area 14.

In another embodiment, each hole 9 in the base part 7 has a width which constitutes more than 3% of the base part area 14, preferably more than 5% of the base part area 14, and even more preferably more than 8% of the base part area 14.

The size of the holes in the base part 7 depends on the size of the formation pieces or the precipitated solids 2 since the holes are able to cut off a certain percentage of the pieces or the solids. In this way, the downhole tool head does not completely grind the pieces or the solids, but also loosens larger pieces. These pieces are maximally 2-20% larger than a hole in the base part, preferably maximally 5-10% larger than the hole. The distance between the downhole tool and the formation may thus be adjusted accordingly.

If this is not possible, the size of the holes 9 is adjusted to correspond with the distance between the outside wall of the downhole tool and the inside wall of the formation, the casing 3 or the pipeline since it is important that the holes are not wider than the gap between the downhole tool and the formation if the cut-off pieces or solids are to be able to pass the downhole tool without the tool getting stuck.

The number of holes 9 depends on the volume flow of the oil fluid since it must be avoided that the pieces or solids block all the holes completely, but let a sufficient amount of oil fluid pass so that the tool is not hindered from moving forward in the casing 3 or formation.

If the formation pieces or the released solids are not able to enter through the holes 9, they will accumulate in the hollow cylindrical body 4. The oil fluid will then force the pieces or the solids to hit against the cutting edges 12 of the hole until a sufficient percentage of the pieces or solids has been torn off from the pieces or solids for them to be able to pass the holes 9 and be released into the cavity fluid.

In this way, it is ensured that only solids or pieces of a predetermined size are allowed to pass the holes 9 in the downhole tool head 1, the size being predetermined by the width of the gap between the downhole tool and the formation or casing 3 to ensure that the solids or pieces will be able to pass through this gap.

Figure 2A:
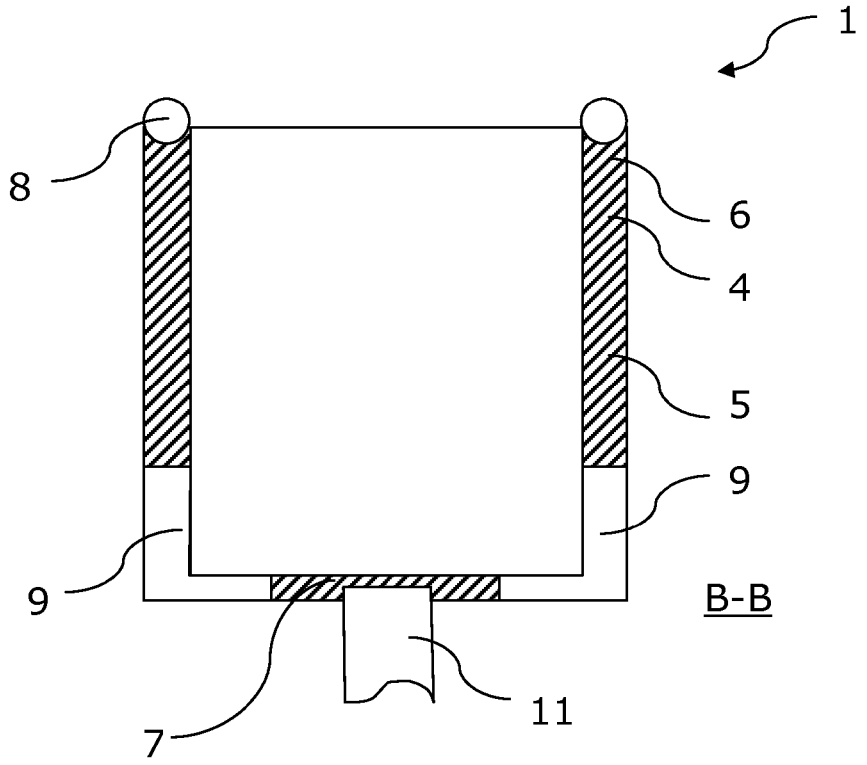
FIG. 2A shows a cross-sectional view of a another embodiment of the downhole tool head.
Figure 2B:
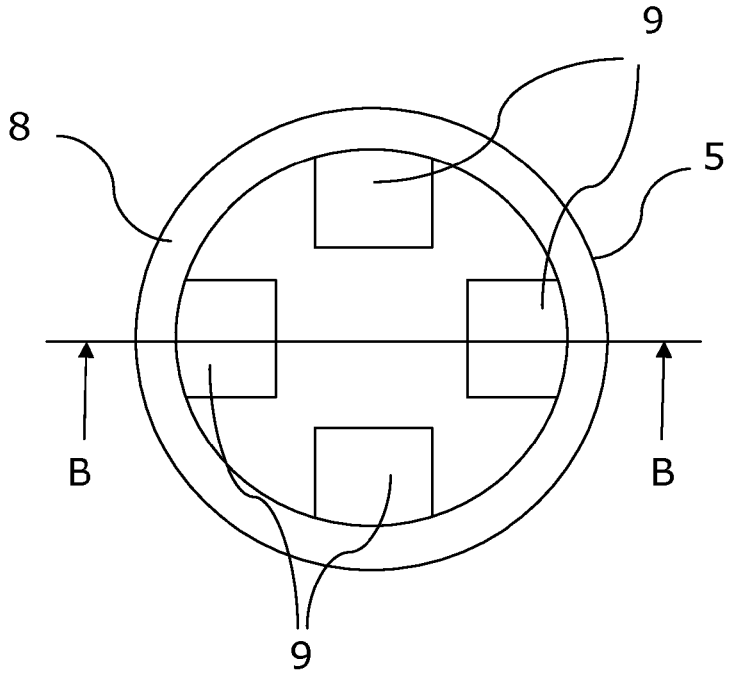
FIG. 2B shows the downhole tool head of FIG. 2A seen from above.

In FIGS. 2A and 2B, the downhole tool head 1 has four holes 9, all of which have a square cross-section. As can be seen from FIG. 2A, each hole 9 extends all the way through the base part 7 of the tool head 1 while also extending up along part of the cylindrical wall 5 of the cylindrical body 4 and through the wall 5.

Figure 3A:
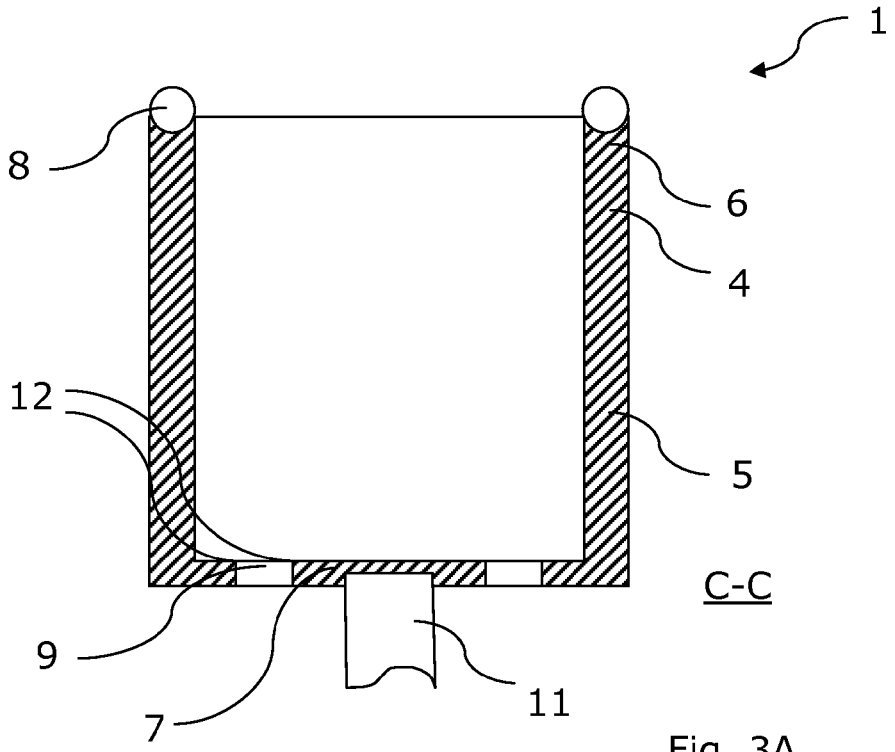
FIG. 3A shows a cross-sectional view of a yet another embodiment of the downhole tool head.
Figure 3B:
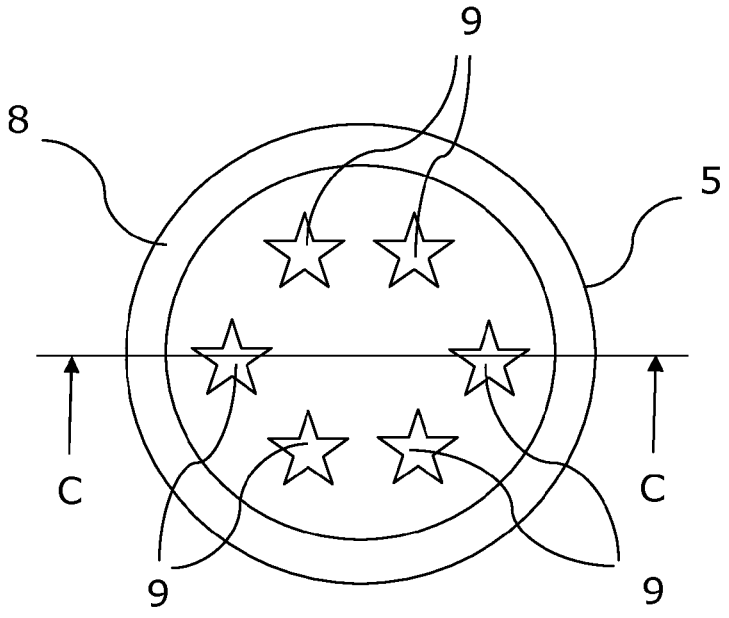
FIG. 3B shows the downhole tool head of FIG. 3A seen from above.

In FIGS. 3A and 3B, the downhole tool head 1 has six holes 9, all of which have a star-shaped cross-section. Hereby, each hole 9 is provided with a longer cutting edge 12 formed with six points, increasing the cutting effect compared to a round hole of approximately the same inner size while, at the same time, the star-shaped hole does not allow substantially bigger formation pieces or solids to pass through.

Figure 4:
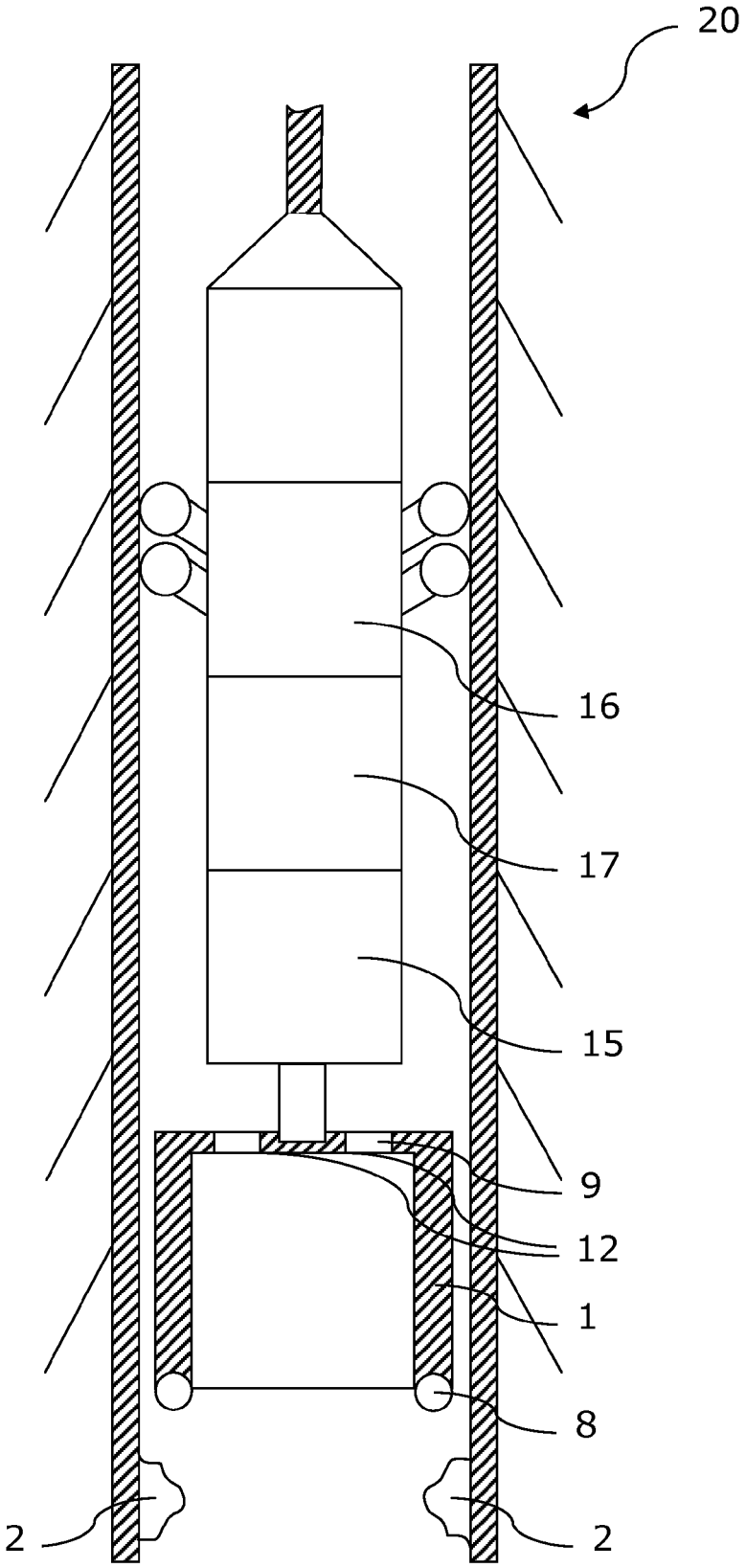
FIG. 4 shows a cross-sectional view of the downhole tool head mounted onto a downhole tool.

A downhole system with a downhole tool having a downhole tool head 1 mounted onto the tool is shown in FIG. 4. The downhole tool is driven by driving tool 16, such as a downhole tractor, for moving the downhole tool in the well. The downhole tool head 1 is rotated by a driving unit 15. As can been seen, the width of the holes 9 in the downhole tool head 1 is substantially the same as the distance between the outside wall of the downhole system and the inside wall of the casing 3.

Figure 5A:
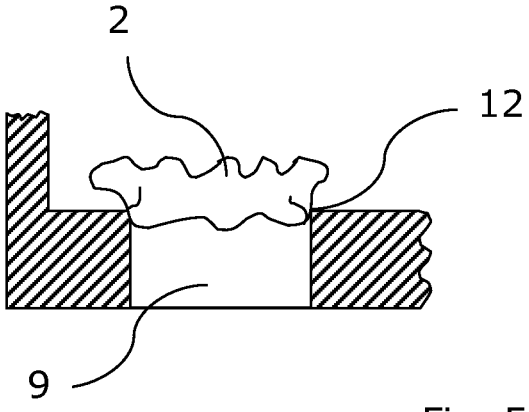
FIG. 5A shows a released precipitated solid, such as a scale, hitting a hole edge of the downhole tool head.
Figure 5B:
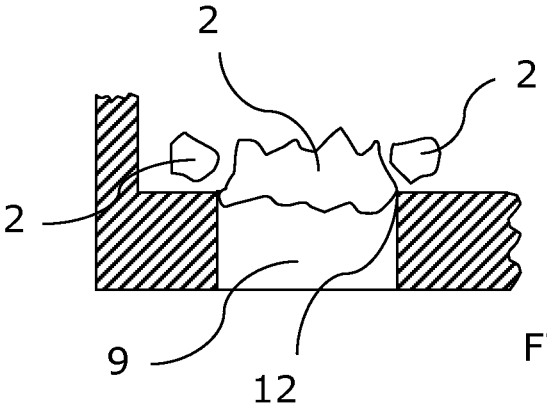
FIG. 5B shows the solid of FIG. 5A divided into three parts.
Figure 5C:
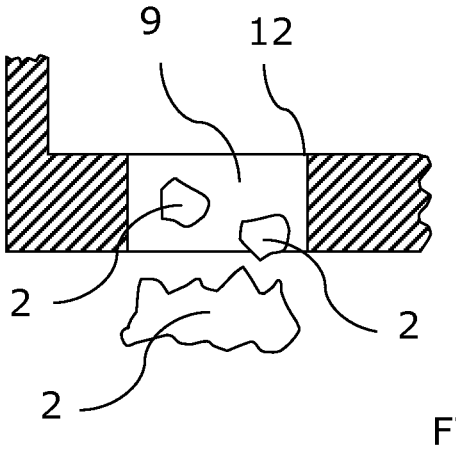
FIG. 5C shows the three parts of FIG. 5B entering the hole of downhole tool head.

In FIGS. 5A-B it is shown how the cutting edge 12 of the hole is able to cut off a part of the released precipitated solid 2 or the formation piece. In FIG. 5A, the solid 2 or piece has hit the edge of the hole 9, resulting in a crack in the solid 2 or piece. When the crack has extended through the entire solid 2 or piece, the solid 2 or piece is divided into three parts, as shown in FIG. 5B. In this way, the piece or solid 2 is reduced into a main part which is then able to pass the hole 9, as shown in FIGS. 5B-5C, and a number (in the present case two) of smaller parts which subsequently enter through the hole, too.

If the main piece or solid 2 of FIG. 5A is not reduced substantially, the oil fluid will force the reduced piece or solid 2 to continue to hit against the edge 12 of the hole 9. When the downhole tool moves forward in the casing 3 or the formation downhole, the downhole tool head 1 is flushed with oil fluid, and the oil fluid is in this way able to force the pieces or solids 2 towards the holes 9 in the downhole tool head 1.

Figure 6:
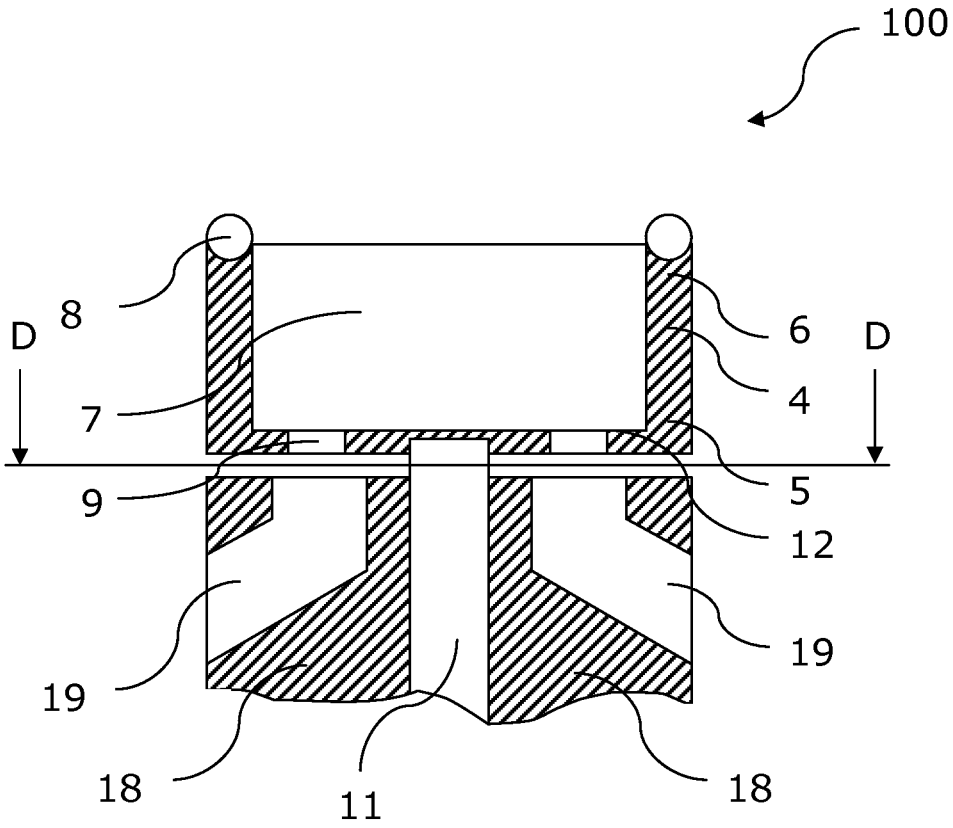
FIG. 6 shows a cross-sectional view of yet another embodiment of the downhole tool head.

In the event that the velocity of the downhole tool is not high enough for the solids 2 to hit against the edges of the holes 9 in the base part of the downhole tool head 1, a crunching element 18 may be arranged between the tool head and the downhole tool, forming a downhole tool head assembly 100, as shown in FIG. 6. The crunching element 18 of downhole tool head assembly 100 comprises at least one channel 19 with an opening in an element face facing the base part of the tool head 1. The element 18 is arranged at a small distance from the base part in order to be able to crunch the solids 2 partly projecting through the holes 9 in the base part. In this way, the solids 2 are crunched into smaller pieces, enabling them to exit the downhole tool head 1 through the holes 9 in the base part. Thus, the solids 2 no longer occupy the space inside the downhole tool head 1, hindering further drilling with the downhole tool head.

The downhole tool head 1 is connected to the downhole tool via a shaft, and the element 18 is arranged around the same shaft and fixated to the downhole tool. The element 18 is thus stationary while the downhole tool head 1 is able to rotate around the longitudinal axis of the downhole tool, forcing the solids 2 partly projecting through the holes 9 in the base part of the tool head to hit against the opening in the element as the tool head rotates. Subsequently, the crunched solids 2 escape through the channel 19 and out into the cavity surrounding the downhole tool.

In FIG. 6, the crunching element 18 is shown as comprising two channels 19; however, the element may comprise more channels in order to ensure that an opening of a channel is always at least partly aligned with the holes 9 in the base part of the tool head 1. An optimal solution is to have at least part of the channel opening overlapping a hole 9 in the base part; however, the element 18 is able to crunch the solids 2 even if the holes do not always overlap the openings during rotation of the tool head 1 in relation to the element.

In order to obtain a crunching effect, the element face of the element 18 must be positioned at a distance from the base part, which is less than the width of one hole 9 in the base part of the tool head 1. If the holes are not circular and thus of dissimilar width, the smallest width of the hole should be used as basis.

The distance between the face of the element 18 and the base part of the tool head 1 may preferably be less than 50 mm, more preferably less than 25 mm, and even more preferably less than 10 mm.

In FIG. 6, the width of the opening of the channel 19 is larger than the width of the holes 9 in the base part; however, the width of the opening may also be equal to the width of the holes. The element 18 is shown as having the same diameter as the tool head 1, but in another embodiment, the diameter of the element may be either smaller or larger than the diameter of the tool head.

The channels 19 of FIG. 6 have the same width as the openings of the channels, and after the solids 2 have entered the opening of the channel, they are guided through a substantially straight chute and out through an opening in the side of the element and thus the downhole tool. The channels 19 may have any suitable cross-sectional shape.

Figure 7A:
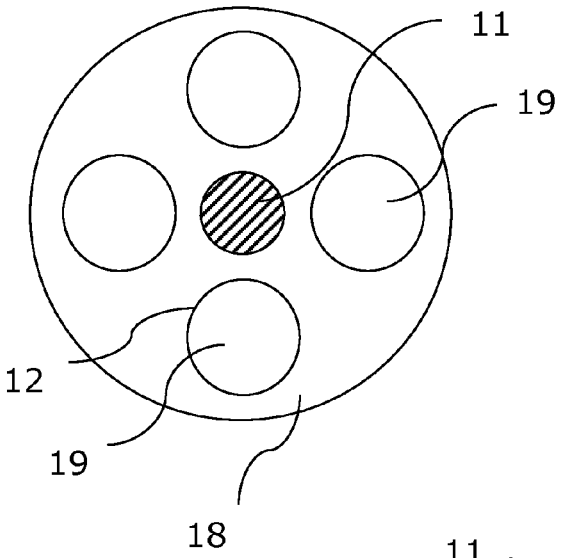
FIG. 7A shows view D-D shown in FIG. 6.
Figure 7B:
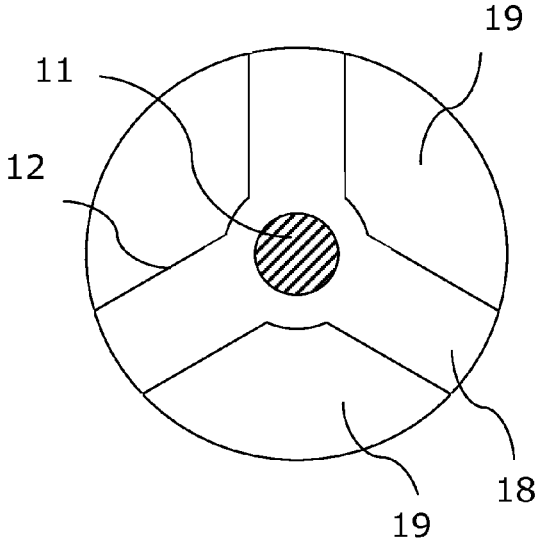
FIG. 7B shows an alternate of view D-D shown in FIG. 6.
Figure 7C:
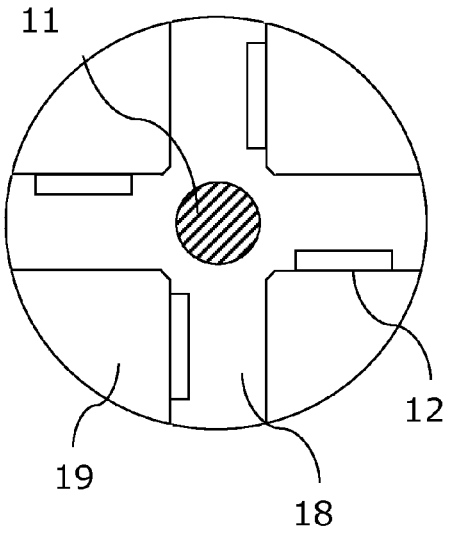
FIG. 7C shows another alternative of view D-D shown in FIG. 6.

FIG. 7A shows the view D-D shown in FIG. 6 of the crunching element 18. The crunching element 18 has four openings 19 and a centre shaft 11 which connects the crunching element and the downhole tool head. In FIGS. 7B and 7C, other embodiments of the crunching element 18 are shown, seen in the same view direction as that of FIG. 7A. In FIG. 7A, the holes are circular, but in another embodiment, the holes may have a more organic shape. In FIGS. 7B and 7C, the openings 19 extend from the top face of the crunching element and along the side of the crunching element so that the edges of the element function as cutting edges 12 when the element passes the holes of the downhole tool head. In FIG. 7B, the element has three openings, and in FIG. 7C, the element has four openings. In FIG. 7C, the element has cutting inserts with a cutting edge 12 so that the material of the element can be different than that of the cutting edge. By having cutting inserts, the cutting ability of the crunching element can easily be improved or re-established by changing the inserts.

In the event that the downhole tool is not submergible all the way into the casing 3, a downhole tractor can be used to push the downhole tool all the way into position in the casing. A downhole tractor is any kind of driving tool capable of pushing or pulling tools in a well downhole, such as a Well Tractor®.

The invention claimed is:

1. Downhole tool head for mounting onto a downhole tool to release precipitated solids in a cavity fluid in a pipeline, a casing, a well or any other cavity downhole, comprising:

a hollow cylindrical body with a circumferential wall extending from a base part of the body, the circumferential wall having a circumferential rim in an end opposite the base part, wherein the circumferential rim comprises a plurality of edges configured to cut, grind, drill or mill by way of rotation of the circumferential rim, wherein the base part has a plurality of through-holes configured to allow passage of cavity fluid comprising precipitated solids from within the hollow cylindrical body and through the through-holes, and wherein each of the through-holes has a cutting edge configured to cut precipitated solids from within the cylindrical body, and to divide the precipitated solids into several pieces, wherein the downhole tool is configured such that the precipitated solids are initially cut, ground, drilled or milled by the plurality of edges of the circumferential rim, and then released directly to the hollow cylindrical body and the cutting edges of the base part for further breakdown so that the precipitated solids are broken down to a size that passes by the tool after passing through the through-holes.

2. Downhole tool head according to claim 1, wherein the base part has a base part area and the holes in the base part constitute more than 20% of the base part area.

3. Downhole tool head according to claim 1, wherein at least one of the holes extends from the base part and up along the circumferential wall.

4. Downhole tool head according to claim 1, wherein each hole in the base part has a width which constitutes more than 1% of the base part area.

5. Downhole tool head according to claim 1, wherein the cutting edge of the hole has a radius of curvature between 0.0 mm and 1.0 mm.

6. Downhole tool head according to claim 1, wherein the circumferential wall has a plurality of holes and a circumferential wall area.

7. Downhole tool head according to claim 6, wherein the holes in the circumferential wall constitute more than 20% of the circumferential wall area.

8. Downhole tool head according to claim 6, wherein each hole in the circumferential wall has a width which constitutes more than 1% of the circumferential wall area.

9. Downhole tool head according to claim 1, wherein the circumferential rim has at least three edges distributed along the rim.

10. Downhole tool head according to claim 1, wherein the edges constitute more than 5% of the circumferential rim.

11. Downhole tool head according to claim 1, wherein a cross-section of at least one of the holes is round or square.

12. Downhole tool head assembly comprising the downhole tool head according to claim 1 and an element arranged between a downhole tool and the downhole tool head, the element comprising openings and an element face which is arranged at a distance from the base part of less than the width of a hole in the base part of the downhole tool head.

13. Downhole tool head assembly according to claim 12, wherein the element comprises channels extending from the openings of the element face and ending at a side of the element to let out cavity fluid through the side.

14. Downhole tool head assembly according to claim 12, wherein at least one opening of the channel overlaps a hole in the base part while the downhole tool head rotates around a longitudinal axis of the tool.

15. Method of operating the downhole tool head according claim 1 for releasing precipitated solids, such as ice, scales, in a cavity fluid in a pipeline, a casing, a well, or any other cavity or for drilling in a formation downhole.

16. Downhole tool, comprising:

the downhole tool head according to claim 1, and a driving unit structured to rotate the downhole tool head, wherein the downhole tool head is provided on a shaft in connection with the driving unit.

17. Downhole system for performing operations downhole, comprising:

a downhole tool according to claim 16, and a driving tool to move the downhole tool in the well.

18. Downhole tool head according to claim 1, wherein the circumferential rim with the plurality of edges has a diameter that is equal to or greater than a diameter of the base part with the through-holes.

19. Downhole tool head according to claim 1, wherein the plurality of edges of the circumferential rim are positioned radially further away from an axis of rotation of the hollow cylindrical body than at least a portion of the cutting edge of each said through-hole.

* * * * *